United States Patent [19]

Saur

[11] Patent Number: 4,642,599

[45] Date of Patent: Feb. 10, 1987

[54] CONTROL DEVICE

[75] Inventor: Roland Saur, Stuttgart, Fed. Rep. of Germany

[73] Assignee: Behr-Thomson Dehnstoffregler GmbH, Fed. Rep. of Germany

[21] Appl. No.: 786,492

[22] Filed: Oct. 11, 1985

[30] Foreign Application Priority Data

Oct. 16, 1984 [DE] Fed. Rep. of Germany ..... 3437778

[51] Int. Cl.[4] ..... H01H 37/76

[52] U.S. Cl. ..... 337/397; 337/393; 337/394

[58] Field of Search ..... 337/393, 394, 397, 315, 337/139, 398; 60/527; 251/11

[56] References Cited

U.S. PATENT DOCUMENTS

| | | | |
|---|---|---|---|
| 3,515,368 | 6/1970 | Kelly | 251/11 |
| 4,225,841 | 9/1980 | Saur et al. | 337/393 |
| 4,389,629 | 6/1983 | Saur et al. | 337/315 |

*Primary Examiner*—Harold Broome
*Attorney, Agent, or Firm*—Barnes & Thornburg

[57] ABSTRACT

A control device having a control element that can be actuated by a thermostatic working element has a multipart structure which includes a primary housing which is preferably made of plastic and a secondary housing which is preferably made of metal. The primary housing is generally U-shaped in cross-section and is provided with an exterior shoulder. The secondary housing is also U-shaped and is provided with an edge which is plastically deformed around the shoulder of the primary housing to secure the housings together. A movable working element extends through a wall of the primary housing and contacts the control element. The secondary housing includes a chamber for receiving a thermally expandable material which is positioned adjacent to an end of the working element. An elastic membrane is disposed between the expandable material and the working element and is secured in position by the primary and secondary housings.

16 Claims, 4 Drawing Figures

CONTROL DEVICE

BACKGROUND AND SUMMARY OF THE INVENTION

This invention relates to a control device having a thermostatic working element and a control element that can be actuated thereby.

Control devices of this type, as shown in German Patent DE-PS No. 24 44 931, have proven themselves in practice and are manufactured and used in large quantities. In the particular device shown in the German Patent, a one-piece metal housing is manufactured as a machined part having a cup-shaped receiving means for the thermally expandable material. The cup-shaped receiving means is closed by a rubber or elastic membrane held by a guide part which is also made of a machined metal part. The guide part is secured in the housing by a beaded edge. The housing is closed by a cover plate made of plastic which has a microswitch attached thereto and which, by means of a flanged edge, is held in the housing.

German Utility Model DE-AS No. 23 48 099 shows a similar control device constructed at least partially of plastic. In the case of this construction, a generally sleeve-shaped basic body made of plastic is provided into which a guide part for the working piston is inserted. A thermostatic working element constructed as an integral unit is then inserted from one side into the basic body. The integral unit consists of a metallic housing with an enclosed thermo-elastic material and a movable working piston provided with a seal. The working element snaps into the basic body by means of a clip arrangement. An end plate which carries a microswitch is inserted into the basic body from the other side. This end plate also snaps into the basic body by means of a clip arrangement. This type of device has not proven itself in practical applications, especially when the integrally constructed thermostatic working element is not held securely enough in the basic body. In addition, the manufacturing costs for this control device are relatively high.

An object of the present invention is to provide a control device of the initially mentioned type which may be manufactured at a greatly decreased cost.

These and other objects are attained in a thermostatic control device which comprises a primary housing, a movable working element extending through a wall of the primary housing, a secondary housing secured to the primary housing and containing a thermally expandable material, and an elastic membrane for retaining the expandable material in place. The primary housing has walls which define a tightly enclosed interior space for enclosing the control element. The movable working element extends through one of these walls and contacts with the control element. The secondary housing, which is fastened to the primary housing, is formed with a cup-shaped receiving means which contains the thermally expandable material. The secondary housing positions and holds the expandable material immediately adjacent to the end of the working element which extends through the exterior of the primary housing wall. An elastic membrane is provided between the expandable material and the working element. The elastic membrane is clamped between the primary housing and an interior surface of the secondary housing.

The secondary housing is preferably secured to the primary housing by plastically deforming an edge of the secondary housing around a shoulder which is integrally formed with the primary housing. For this reason, the secondary housing is preferably formed of metal, while the primary housing is preferably formed of plastic. The secondary housing is preferably a stamped sheet metal part. In another preferred embodiment, a fastening structure, such as external threads, is provided on the exterior of the secondary housing. The control device of the present invention may be utilized with a microswitch to form an electrical control device, or with a valve arrangement to form a hydraulic or pneumatic control device.

By means of this development, it is possible to manufacture the housing from less expensive and more easily machined materials than previously, so that significant savings can be achieved during manufacturing. These savings are very important since control devices of this type are used in very large quantities and a decrease in cost is an important advantage.

In a preferred embodiment of this invention, the secondary housing is constructed as a plastically deformed sheet-metal part. These sheet-metal parts may be manufactured very easily by deep-drawing, pressing, or stamping at low costs. In another embodiment of the invention, the secondary housing is provided with a fastening arrangement on its exterior surface. This provides for the secure fastening of the control device to other structures for extended periods of time.

In another preferred embodiment of the invention, the primary housing is manufactured in one piece with a guide part for the working element. In this embodiment, further simplification is achieved since the primary housing and the guide part can be simply manufactured as a molded plastic part. In the case of this embodiment, only an end plate and the secondary housing must be manufactured separately. The end plate, which is also preferably made of plastic, is connected to an edge of the primary housing by means of ultrasonic welding.

In yet another embodiment of the invention, the primary housing is manufactured in one piece with the end plate. In this embodiment, the guide part for the working piston is a separate structural part which, however, can also be manufactured easily as a molded plastic part. Assembly then becomes especially simple, with the guide part held between the primary and secondary housings. A separate fastening of the guide part will then not be required.

DETAILED DESCRIPTION OF THE DRAWINGS

Figure 1:
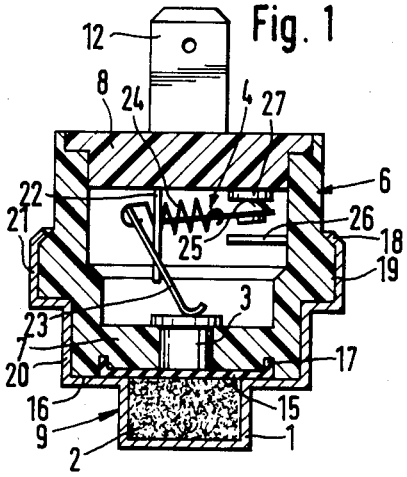
FIG. 1 shows a sectional view of one embodiment of an electrical control device constructed in accordance with the present invention in which the primary housing is formed in one piece with a guide part for the working piston.

The control device of FIG. 1 has a primary housing which is a molded part preferably made from a thermoplastic material. The primary housing 6 is U-shaped in cross-section. A plastic end plate 8 is inserted into its open end. The edges of end plate 8 and of the primary housing 6 are stepped so that a seat for the end plate 8 is created. The edges of the two plastic parts are preferably constructed of the same plastic material and are preferably glued or welded ultrasonically to one another.

The end plate 8 carries a microswitch 4 located on the inside of the space which is tightly enclosed by the primary housing 6 and the end plate 8. The microswitch 4 has a support 22 which is formed in one piece with a contact 12 projecting outwardly and which is cast or injection molded with the end plate 8. A switching rocker 23 provided with a recess is fitted into the support 22, and is non-fixedly held at the support 22. A contact spring 24 is secured to one end of the switching rocker 23. The other end of the contact spring 24 is secured in a contact tongue 25 which is supported at its blade-type end in a groove in the support 22. The contact tongue 25, at its free end, is equipped with a contact with which stationary switching contacts 26 and 27 are associated. One or both of the two switching contacts 26 and 27 are formed in one piece with contacts which, like contact 12, extend out of the housing. When the switching rocker 23 is pivoted out of a starting position illustrated in the Figures, the end of the contact spring 24 which is coupled to its outside arm moves beyond the bearing point of the contact tongue 25 so that the direction of force on the contact spring 24 changes abruptly causing the contact tongue to snap into the other position in which its contact will press against the switching contact 26.

The bottom of the primary housing 6 is formed with a guide part 7 for a working piston 3. The guide part 7 has a central recess in which the working piston 3 is guided which, in the position shown, supports itself on the inside of the guide part 7 by means of a widened head on which the switching rocker 23 rests.

The housing of the control device according to FIG. 1 includes a secondary housing 9 which is preferably made of brass sheet as a pressed or stamped sheet-metal part. The secondary housing 9 has a cup-shaped receiving means 1 for an elastic (expandable) material 2. The cup-shaped receiving means 1 is sealed by a rubber-elastic membrane 15. An edge 17 of the rubber-elastic membrane 15 is inserted into a corresponding recess in the exterior side of guide part 7. Edge 17 of membrane 15 surrounding the cup-shaped receiving means 1 is clamped between the exterior side of guide part 7 and a contact surface 16 of secondary housing 9. Guide part 7 has a surrounding edge which, by means of a countersurface extending in a radial plane, is opposite contact surface 16. Edge 17 and the immediately adjacent area of membrane 15 are located in a step-shaped part of guide part 7 which is dimensioned in such a way that when the outside edge of the exterior surface of the guide part 7 is flush with the contact surface 16, the edge area of membrane 15 is elastically compressed.

An edge of the generally U-shaped (in cross-section) secondary housing 9 extends around a surrounding outside shoulder 19 of the primary housing 6. This outside shoulder is formed with a shoulder or stop slope around which the edge 18 of the secondary housing is plastically deformed. Prior to deforming this edge, the primary housing and the secondary housing 9 are clamped together such that the edge of guide part 7 rests securely against contact surface 16 of secondary housing 9. The outside shoulder 19 is located at about the middle of the primary housing 6. A step-shaped cylindrical section having a smaller diameter extends in the direction of the cup-shaped recess 1. Sections 20 and 21 of the metallic secondary housing 9 correspond to the step-shaped sections of the primary housing 6 so that a step-shaped stop is formed for use in the installation of the control device into a housing or similar device. The cup-shaped receiving means 1 forms another step with the section 20.

As a modification of the embodiment shown, section 20 of the secondary housing 9 is formed with an external thread. Section 21, and the corresponding outside shoulder 19 of the primary housing 6, are then formed with a polygonal external contour, in particular a hexagonal contour, which is used for the application of a tool. In this case, edge 18 is equipped with notches which correspond to the contour so that, despite this contour, a perfect flanging of edge 18 around the outside shoulder 19 is possible.

As shown in FIG. 1, the entire housing of the control device consists of three parts, namely the primary housing 6 which is constructed in one piece with the guide part 7, the end plate 8 and the secondary housing 9. These parts can be easily and cost-effectively manufactured in the desired shapes and with the desired precision in very large quantities.

Figure 2:
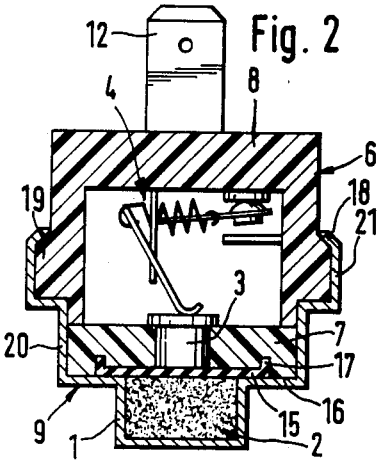
FIG. 2 shows a sectional view of an embodiment of an electrical control device constructed in accordance with the present invention in which the end plate carrying the electric switch is constructed in one piece with the primary housing and the guide part is constructed as a separate structural part.

In the embodiment shown in FIG. 2, the housing of the electric control device also consists of three parts. However, in this embodiment, end plate 8 is formed in one piece with the primary housing 6, while guide part 7 is an independent structural part. Secondary housing has a shape which corresponds to that of the embodiment according to FIG. 1. In this emboidment, guide part 7 is constructed in the shape of a plate on which the edge of the primary housing 6 is supported. To assemble this structure, guide part 7 is first inserted into secondary housing 9. Subsequently, the primary housing 6 is mounted and supported by its edge on guide part 7. The primary housing 6 and the secondary housing 9 are then pressed together so that the edge of the primary housing 6 the countersurface of guide part 7 press against the contact surface 16 which surrounds the cup-shaped receiving means 1 of the secondary housing 9. The flanging of the edge 18 then takes place as those parts are pressed-together. The construction of microswitch 4 corresponds to the embodiment according to FIG. 1.

Figure 3:
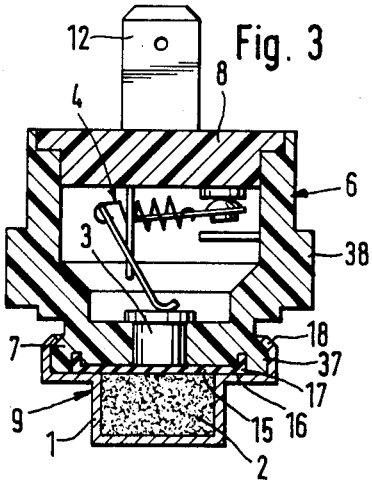
FIG. 3 shows a sectional view through an embodiment similar to that of FIG. 1, but which has a modified arrangement for fastening the primary and secondary housings together.

The embodiment according to FIG. 3 is similar, in its basic construction, to the embodiment according to FIG. 1. A primary housing 6 made of plastic is formed in one piece with a guide part 7 for a working piston 3. An end plate 8 is inserted into the open edge of the primary housing 6. The end plate 8, corresponding to the embodiment according to FIG. 1, is equipped with a microswitch 4. However, secondary housing 9 in this embodiment is constructed as a simplified molded sheet-metal part. Guide part 7 of the primary housing 6 is provided with a surrounding outside shoulder 37. Edge 18, which connects to the contact surface 16 which surrounds the cup-shaped receiving means 1, is flanged around outside shoulder 37. Also in this embodiment, the primary housing 6 and the secondary housing 9 are clamped together so that the edge of the guide part surrounding edge 17 of the membrane is flush with contact surface 16 of secondary housing 9, in which case the edge 17 and the immediately adjacent area of membrane 15 is elastically compressed. Subsequently, edge 18 is flanged around the sloped edge of outside shoulder 37. In this embodiment, the primary housing 6 is formed with a surrounding fastening flange 38 which has a larger diameter than the outside shoulder 37 and the edge 18 of the secondary housing 9 which is flanged around it.

Figure 4:
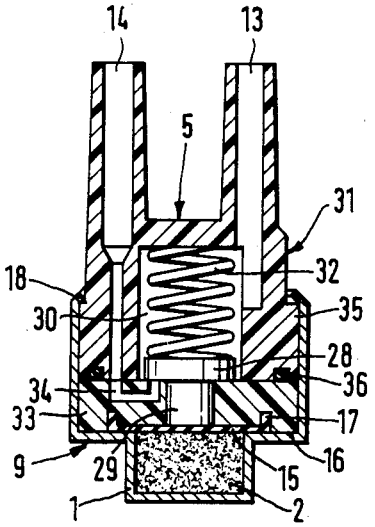
FIG. 4 is an embodiment of a control device which is constructed as a valve.

The embodiment according to FIG. 4 shows a control device that is formed as a valve 5 in which the valve passage is opened or closed depending on the temperature. This control device has a housing which is also constructed of three parts. A primary housing 31 is constructed of a plastic material and is provided with two passages 13 and 14. Passage 13 leads into a chamber 30 of the primary housing 31. A closing spring 32 is supported at the end of chamber 30 on a valve body 28. Valve body 28 is internally formed with a working piston 29 which is guided in a guide part 33. The guide part 33 has a countersurface on a surrounding edge which is supported by a contact surface 16 which surrounds a cup-shaped receiving means 1, within which an expandable material 2 is housed. A membrane 15 is arranged between the working piston 29 and the expandable material 2. Edge 17 of the membrane is inserted into a recess on guide part 33. When assembled, the area of edge 17 which immediately surrounds the cup-shaped receiving means 1 is elastically deformed.

A connecting duct 34 is provided in guide part 33 which, in the area of the head of the working piston 29 which acts as the valve body 28, leads into chamber 30 and which is connected via a duct 34, with line 14 of the primary housing 31. The primary housing 31 is supported by a radial flat surface on a corresponding surface of guide part 33. For sealing purposes, a sealing ring 36 is arranged between the two surfaces, the diameter of which is chosen in such a way that it is outside the connecting duct 34.

The cup-shaped receiving means 1 is a component of secondary housing 9 which is constructed as a sheet-metal stamping. An edge 28 of secondary housing 9 extends and is flanged around an outside shoulder 35 of the primary housing 31. Also in the base of this embodiment, guide part 33 and the primary housing 31 are first inserted into secondary housing 9 after which the primary housing 31 and secondary housing 9 are pressed together until the counter surface of the guide part 33 rests flush against contact surface 16 which surrounds the cup-shaped receiving means 1. Subsequently, the flanging of the edge 18 takes place.

In the case of the embodiment according to FIG. 4, lines 13 and 14 can be used selectively as feeding lines or discharge lines. When line 14 is the feeding line, the valve 5 may at the same time be used as a pressure control valve.

In the case of the embodiment according to FIGS. 2 and 4, the guide parts 7 and 33 are each independent structural parts. They may, therefore, be constructed of either metal or plastic.

From the preceding description of the preferred embodiments, it is evident that the objects of the invention are attained, and although the invention has been described and illustrated in detail, it is to be clearly understood that the same is by way of illustration and example only, and is not to be taken by way of limitation. The spirit and scope of the invention are to be limited only by the terms of the appended claims.

What is claimed is:

1. A control device having a thermostatic working element and a control element which is actuated thereby, comprising:

nonmetallic primary housing means, having walls which define an interior space, for enclsoing the control element;

a movable working element, extending through one of the walls of said primary housing means, for actuating the control element;

metallic secondary housing means, secured to the primary housing means and having means for receiving a thermally expandable material and means for holding said material immediately adjacent to the working element; and elastic means, disposed between the expandable material and the working element and between the primary housing means and an interior surface of the secondary housing means, for retaining the expandable material in said receiving means;

wherein an edge of the secondary housing means is plastically deformed around a shoulder of the primary housing means to secure the housings together.

2. A control device according to claim 1, wherein the primary housing means is formed of plastic, and wherein the edge of the secondary housing means and the shoulder of the primary housing means extend around an outer surface of the primary housing means.

3. A control device according to claim 1, wherein the secondary housing means is formed from a plastically deformed sheet-metal part.

4. A control device according to claim 1, wherein the secondary housing means comprises a metal part provided with means for fastening the control device to a separate structure.

5. A control device according to claim 4, wherein said fastening means comprises an external thread on said secondary housing means.

6. A control device according to claim 5, wherein the secondary housing means is provided with flattened sections to facilitate the use of a tool to fasten the control device to said separate structure.

7. A control device according to claim 6, wherein the flattened sections on the secondary housing means are in contact with corresponding flattened sections of the primary housing means.

8. A control device according to claim 1, wherein the primary housing means includes integrally formed guide means for guiding the movable working element.

9. A control device according to claim 1, wherein the primary housing means includes an integrally formed end plate to which the control element is fastened.

10. A control device according to claim 9, wherein the primary housing means further includes guide means, disposed between the primary and secondary housing means, for guiding the movable working element.

11. A control device according to claim 10, wherein the guide means is compressed between an end surface of the primary housing means and said interior surface of the secondary housing means.

12. A control device according to claim 11, wherein an edge of the elastic means is pressed between and elastically deformed by the interior surface of the secondary housing means and the guide means.

13. A control device according to claim 1, wherein the control element comprises a micrsoswitch having a support mounted to the primary housing means, a switching rocker coupled to the support and contacting the working element, and a switching spring connected to the support and to a contact tongue which can be moved between a pair of electrical contacts.

14. A control device according to claim 1, wherein the control element comprises valve means and wherein said primary housing has inlet means and outlet means which are connected by said valve means.

15. A control device according to claim 14, wherein the working element has a head which serves as a valve body and which is disposed in the interior space of the primary housing means and is biased by a spring into a closed position, and wherein said internal space is connected to at least one of said inlet and outlet means by a duct which can be opened and closed by the working element head.

16. A control device according to claim 1, wherein the secondary housing means is a unitary structure having a substantially uniform wall thickness.

* * * * *